US005479788A

United States Patent [19]

Roegner

[11] Patent Number: 5,479,788

[45] Date of Patent: Jan. 2, 1996

[54] REFRIGERANT RECOVERY SYSTEM

[76] Inventor: Jerry J. Roegner, 14710 Cloverdale Rd., Woodbridge, Va. 22193

[21] Appl. No.: 120,206

[22] Filed: Sep. 13, 1993

[51] Int. Cl.[6] ..... F25B 45/00

[52] U.S. Cl. ..... 62/292; 62/77

[58] Field of Search ..... 62/77, 292, 149, 62/475, 85

[56] References Cited

U.S. PATENT DOCUMENTS 4,805,416 2/1989 Manz et al. ..... 62/292
4,903,499 2/1990 Merritt ..... 62/292
5,123,259 6/1992 Morgan ..... 62/292
5,189,881 3/1993 Miles ..... 62/77
5,269,148 12/1993 Ludwig ..... 62/292

*Primary Examiner*—John M. Sollecito
*Attorney, Agent, or Firm*—Klima & Hopkins

[57] ABSTRACT

A refrigerant recovery system and apparatus. The system includes a main compressor unit connected to a subcooler unit for cooling refrigerant being recovered to increase the rate of recovery and increase the amount of refrigerant recovered in a recovery tank.

14 Claims, 9 Drawing Sheets

REFRIGERANT RECOVERY SYSTEM

BACKGROUND OF THE INVENTION

1. Field of the Invention

A system for collecting refrigerant from a refrigerant system into a recovery tank. The system includes a main compressor unit for compressing the refrigerant and a refrigerant subcooler unit for cooling the refrigerant from the main compressor unit.

2. Prior to Invention

The recovery of used refrigerant from commercial and residential cooling systems is a large business in the United States. Currently, refrigerant R-12, R-22 and R-502 are being recovered in large quantities, and then processed at any of a number of different Environmental Protection Agency (EPA) approved recycling facilities.

The on-site recovery of refrigerant typically involves the use of any of a number of portable commercially available main compressor units along with a plurality of recovery tanks for collecting the refrigerant for transportation. The recovery tanks can only be partially filled by these commercially available units, thus, a plurality of tanks are required. Otherwise, a service person must transport a partially filled recovery tank back-and-forth between the work site and refrigerant recovery plant a number of times to accomplished the same effect of using plural recovery tanks at one time for a large system recovery or several smaller systems.

SUMMARY OF THE INVENTION

An object of the present invention is to provide an effective refrigerant recovery system and apparatus for use on the refrigerant system.

Another object of the present invention is to provide a refrigerant recovery system for compressing the refrigerant in a main compressor unit and cool the refrigerant from the main compressor unit prior to collection in a recovery tank.

The main concept of the recovery system and apparatus according to the present invention is to subcool the refrigerant being recovered, to a temperature low enough to condense the liquid as much as possible at a lower pressure. This cools the recovery tank and lowers the tank pressure in the process.

By subcooling the refrigerant and recovery tank, transfer of the refrigerant is faster, and the recovery tank pressure does not build to equal head pressure as fast. If the recovered refrigerant is cycled from the recovery tank back through the recovery unit with subcooler, and then back to the tank, the recovery tank pressure and temperature will lower. This enables a technician to fill the tank to a complete 80% limit.

An optional fill switch can be provided, which shuts of the recovery unit when the recovery tank is eighty percent (80%) filled. Thus, a digital weight scale would not be needed. However, it is noted that not all recovery tanks have an eighty percent (80%) fill float switch.

One of the two most important components is the subcooler unit, which uses antifreeze as a heat sink. This allows refrigerant being recovered to pass through at varying rates without risk of liquid feedback to the subcooler compressor. The antifreeze also aids in subcooling as the flow rate increases. As the recovery tank loses volume in filling, the incoming refrigerant will lose its ability to remove heat from the tank. Recycling the refrigerant gas in the recovery tank back through the recovery apparatus will increase liquid refrigerant in the recovery tank, and becomes necessary when a warm partially filled recovery tank is used, or if the tank becomes warm.

The performance of any refrigerant recovery system depends on several factors, including:

1) size of recovery tank;
2) the amount of hot gas refrigerant in the recovery tank;
3) whether or not a vacuum was drawn on the recovery tank;
4) the temperature of the indoor and outdoor coil; and
5) indoor and outdoor ambient temperature.

DETAILED DESCRIPTION OF PREFERRED EMBODIMENTS

The system and apparatus according to the present invention can be arranged in a variety of different configurations. The configuration is varied based on differences in operations, or differences in various phases of the recovery operation.

Figure 1:
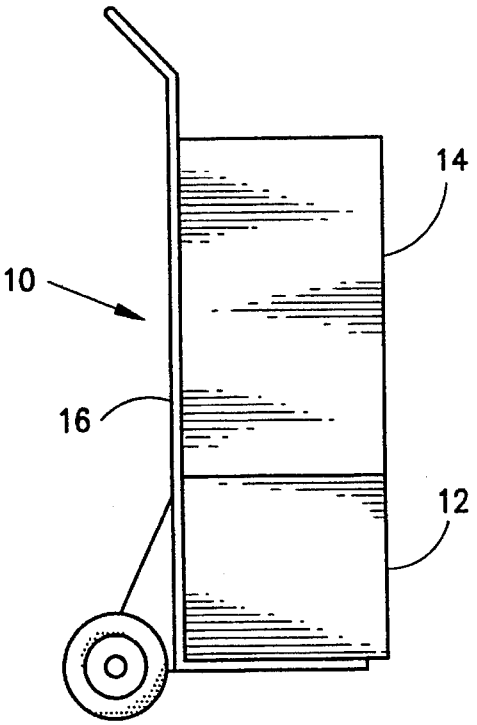
FIG. 1 is a side view of an embodiment of the refrigerant recovery unit according to the present invention.
Figure 2:
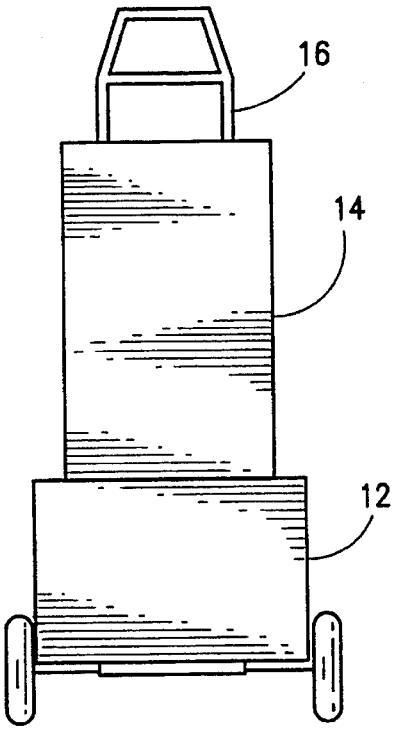
FIG. 2 is a front view of an embodiment of the refrigerant recovery unit, as shown in FIG. 2.

A liquid recovery apparatus 10 according to the present invention is shown in FIGS. 1 and 2. The recovery apparatus comprises two (2) basic units including a main compressor unit 12 operationally connected to a subcooler unit 14. Preferably, the subcooler unit is mechanically connected and situated on top of the main compressor unit 12. Alternatively, the main compressor unit 12 can be a conventional recovery unit with a subcooler unit 14 according to the present invention installed thereon.

The main compressor unit 12 and subcooler unit 14 are carried on a hand truck 16 to render the apparatus 10 portable due to the substantial weight of the components (approx. 160 lbs.). The main compressor unit 12 is significantly heavier than the subcooler unit 14, thus, the main compressor unit 12 is preferably positioned in the lower position on the hand truck. A detailed description of each component will be described hereinbelow.

The recovery apparatus 10 can be used in a variety of applications for recovering refrigerant from an existing refrigerant system. Typically, used refrigerant containing contaminants such as moisture, oil and other contaminates from an existing refrigerant system is recovered during servicing of the existing refrigerant system. This procedure is done to initially evacuate the existing refrigerant so that the refrigerant system can be recharged with new refrigerant and/or can be broken down to service or replace worn or damaged components such as a compressor or heat exchanger core.

QUICK LIQUID RECOVERY APPLICATION

Figure 3:
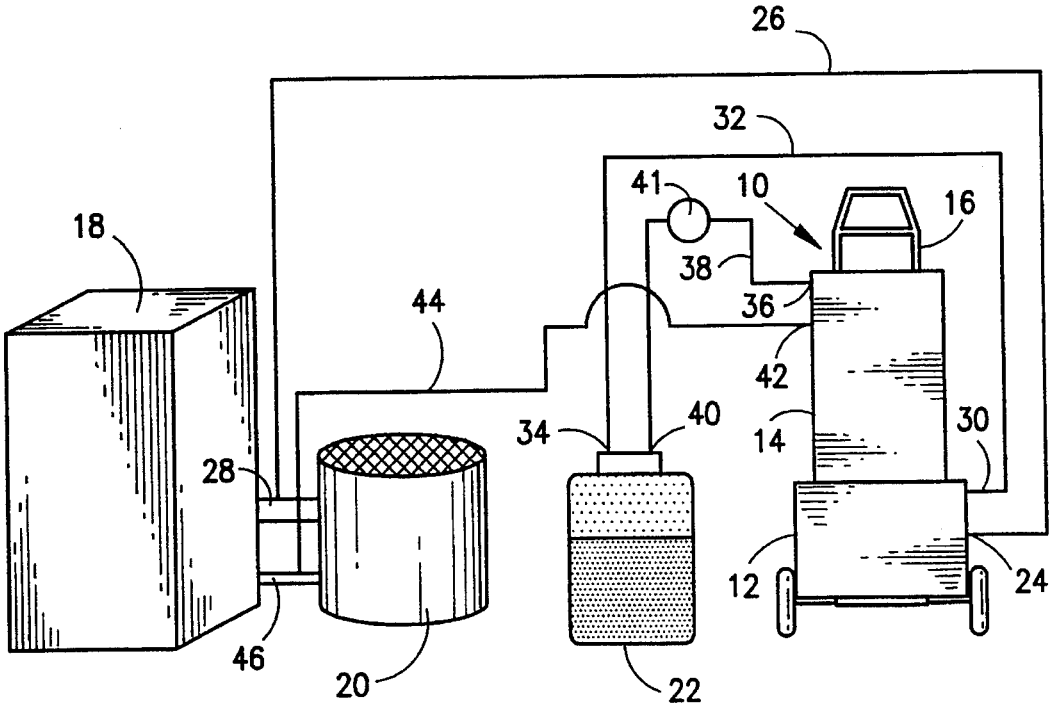
FIG. 3 is a schematic diagram of the recovery unit shown in FIGS. 1 and 2 in a particular application for recovering refrigerant from an air handler with an outdoor unit.
Figure 4:
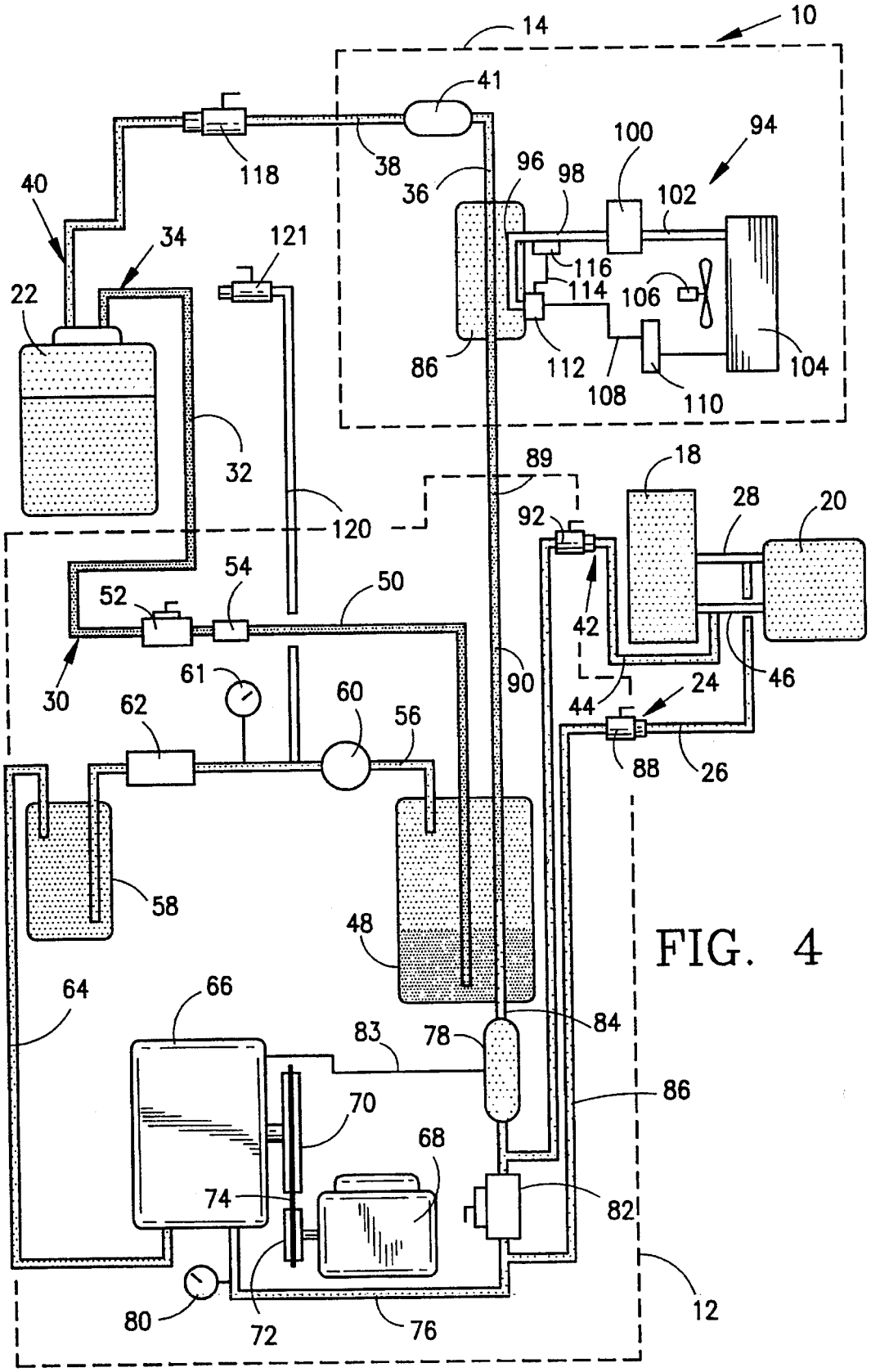
FIG. 4 is a detailed schematic diagram of a quick liquid recovery application embodiment of the refrigerant recovery system according to the present invention.

The configuration for quick liquid recovery operation is shown in FIGS. 3 and 4.

In this application, the recovery apparatus 10 is connected to an air handler 18 having an outdoor unit 20 for recovering used refrigerant therefrom. Further, the recovery apparatus 10 is connected to a recovery tank 22 for collecting the used refrigerant from the air handler 18 and outdoor unit 20.

The outport 24 of the main compressor unit 12 10 is connected by a service line 26 into the low pressure return line 28 between the air handler 18 and outdoor unit 20. The inport 30 of the main compressor unit 10 is connected by a service line 32 to the vapor port 34 of the recovery tank 22.

The outport 36 of the subcooler 14 is connected by a service line 38 to the liquid port 40 of the recovery tank 22. The service line 38 is provided with a sight glass 41 and a Schrader ball valve 118. The in-port 42 of the subcooler unit 14 is connected by the service line 44 to the liquid line 46 between the air handler 18 and outdoor unit 20.

MAIN COMPRESSOR UNIT

A detailed schematic diagram of the recovery apparatus 10 according to the present invention is shown in FIG. 4.

The main compressor unit 12 comprises an accumulator 48 connected by line 50 to the inport 30. A regulating ball valve 52 and a one way valve 54 are provided in the line 50. The accumulator 48 is connected by line 56 to another accumulator 58. A sight glass 60, a low pressure gage 61, and a pressure regulator 62 are provided in the line 56. The accumulator 58 is connected by line 64 to a compressor 66 (e.g. 1½ Hp). The compressor 66 is driven by a motor 68 (e.g. electric or fuel powered) via pulleys 70,72 and drive belt 74.

The compressor 66 is connected by a high pressure line 76 to an oil separator 78. A high pressure gauge 80 and subcooler valve 82 (e.g. regulating ball valve) are provided in the high pressure line 76. An oil return line 83 is provided between the oil separator 78 and compressor 66. The oil separator 78 is connected by line 84 to the accumulator 48. The outport 24 of the main compressor unit 12 is connected by a line 86 to the line 76, which connects between the compressor 66 and oil separator 78. A flare ball valve 88 is supplied at the outport 24 for providing a quick connect/disconnect coupling between the service line 26 and main compressor unit 12 during a refrigerant recovery operation.

SUBCOOLER UNIT

The main compressor unit 12 is connected to the subcooler unit 14 by line 89. Specifically, the subcooler unit 14 comprises a heat exchanger 86, which is connected to the accumulator 48 of the main compressor unit 12 via line 89. The inport 42 of the subcooler unit 14 is connected by a line 90 to line 76, which connects between the compressor 66 and oil separator 78. A flare ball valve 92 is supplied at the inport 42 of the subcooler unit 14 to provide a quick connect/disconnect coupling between the service line 44 and subcooler unit 14 during a refrigerant recovery operation. Thus, the main compressor unit 12 and subcooler unit in this embodiment are interconnected in this manner, however, it would be possible with appropriate connectors to make the main compressor unit 12 and subcooler unit 14 completely separate units without common lines 76, 84 and 89.

The heat exchanger 86 is sealed and liquid filled, preferably with antifreeze as an effective heat exchange medium. A cooling circuit 94 defined by a coil 96 disposed in the heat exchanger 86 is connected by a line 98 to a compressor 100. The compressor 100 is connected by a line 102 to a low temperature condenser unit 104 having an electric fan 106. The condenser unit 104 is connected by a line 108 to the cooling coil 96 of the heat exchanger 86. A sensor capillary tube 114 provided with an expansion valve sensor bulb 116 connects between the suction line 98 at the cooling coil 96 connection and the expansion valve 112.

The heat exchanger 86 is connected to the outport 36 of the subcooler unit 14. The service line 38 connects the outport 36 to the liquid port 40. The sight glass 41 is located external to the physical casing of the subcooler unit to provide accessibility for viewing thereof. A flare valve 118 is provided in the service line 38 to provide a quick connect/disconnect coupling between the subcooler unit 14 and recovery tank 22 during a refrigerant recovery operation.

RECOVERY TANK

The recovery tank 22 is a separate and detachable unit, and can be replaced with another recovery tank 22 after filling thereof. The vapor port 34 of the recovery tank 22 is connected by the line 32 to the inport 30 of the main compressor unit 12. The liquid port 40 is connected by the line 38 to the outport 36 of the subcooler unit 14.

OPERATION

The quick liquid recovery method is recommended for use only on high volume type recovery. On systems of ten (10) pounds or less of refrigerant, more time is spent on making service hose connections than saved in the recovery procedure. When this procedure is used, the capability of this embodiment to accomplish low (subcooler) cold trap temperatures on refrigerant entering the recovery tank, makes this configuration the best. The unique ability of this machine to separate the low temperature condensing section (subcooler) from the main compressor unit facilitates maximum capability and versatility.

The subcooler valve 82 is placed in the "off" position, and the subcooler unit 14 is energized as soon as possible. The system is operated until the sight glass 41 clears of any liquid.

In this application, hot refrigerant gas is injected into the suction line 28 of the system being recovered, while the liquid line 46 returns liquid refrigerant back into the recovery tank 22. The vapor port 34 of the recovery tank 22 is then used to return vapor back to the recovery unit inlet 30 to be cycled one or more times, and eventually liquidified and collected in the recovery tank 22.

In this application, the recovery tank 22 is being used as an accumulator. It is at this time the greatest recovery rate occurs. Cooling the incoming liquid refrigerant into the recovery tank 22 allows rapid recovery and greater filling of the recovery tank 22.

REGULAR LIQUID RECOVERY METHOD

Figure 5:
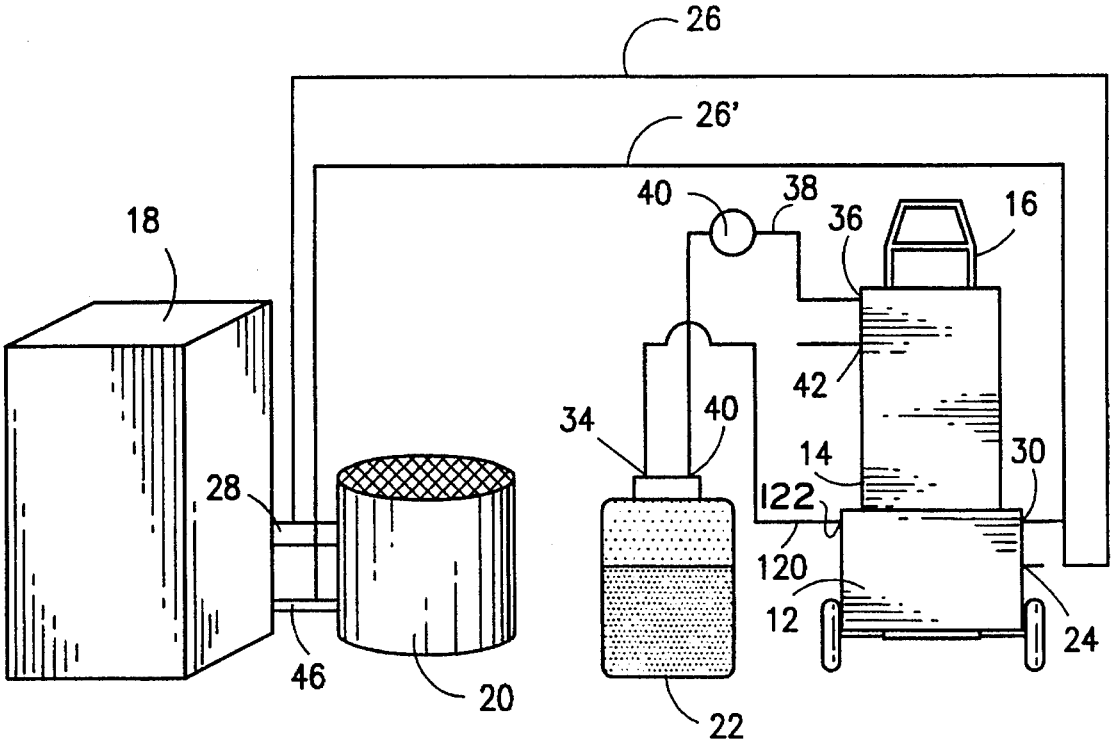
FIG. 5 is a schematic diagram of a regular liquid recovery application embodiment of the refrigerant recovery system according to the present.
Figure 6:
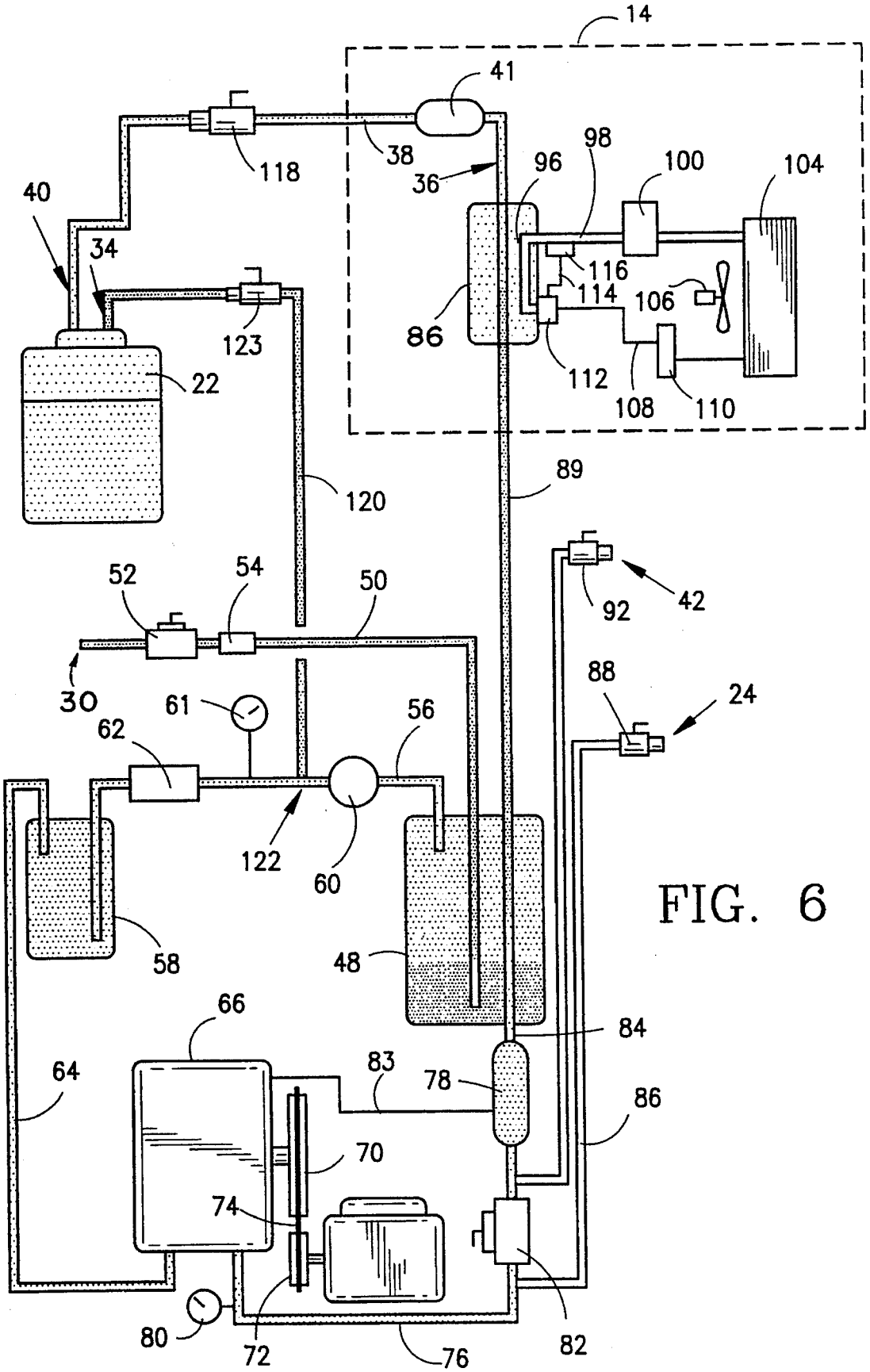
FIG. 6 is a detailed schematic diagram of a regular liquid recovery application embodiment of the refrigerant recovery system according to the present invention.

The configuration for regular liquid recovery operation is shown in FIGS. 5 and 6.

In this application, the low pressure return line 28 and high pressure supply line 46 between the air handler 18 and outdoor unit 20 are both connected by common lines 26,26' to the inport 30 of the main compressor unit 12. Further, the vapor port 34 of the recovery tank 22 is connected by a line 120 to a tank inlet 122 (i.e. line 56 connected between accumulators 56 and 58). A flare ball valve 123 is provided on the line 120. The outport 24 of the main compressor unit 12 and the inport 42 of the subcooler unit 14 remain closed.

This application is the most practical recovery procedure, and the only procedure needed for almost all residential systems. For the most rapid recovery of refrigerant, the vapor port 34 on the recovery tank is closed until the tank pressure slows the recovery process. Throttling the vapor port 34 slightly open at this point will relieve tank pressure enough to speed up refrigerant flow. Opening the vapor port 34 too much decreases the suction volume on the system being recovered. The one way valve 54 will always prevent losing refrigerant back to the system being recovered. Opening the vapor port 34 too much causes most of the refrigerant going through the main compressor unit 12 to be from the recovery tank rather than desireably recovering refrigerant from the system being recovered.

Attention spent in observing the sight glass on the subcooler outlet 41 and the low pressure gauges 61 and service manifold gauges on the system being recovered will aid in throttling the recovery tank vapor port properly. Depending on the volume of refrigerant to be recovered, the time spent in this process on an average residential system should be no more than twenty (20) minutes.

The subcooler is energized as soon as possible for best results. The subcooler valve 82 is moved into the open position, and the apparatus is operated until the refrigeration system is emptied, or the recovery tank becomes 80% full.

Recovery made in this manner will allow recovery of all the remaining refrigerant in the system being recovered. The design of the recovery system allows for relieving the accumulating pressure and temperature caused by the recovery compressor 66 on the recovery tank. This system design also prevents any recovered refrigerant from returning to the system being recovered.

The recovery tank can remain connected in the manner shown until reaching the 80% fill limit. When the pressure at the pressure gauge 61 from the vapor port 34 of the recovery tank 22 matches the inlet pressure from the system being recovered at service gauges on the system to inlet port 30, the vapor port valve 34 on the tank is to be restricted or shut down until the vacuum level is accomplished on the system being recovered. When the vacuum level is accomplished on the system being recovered, the inport 52 is shut down and the vapor port 34 of the recovery tank 22 is opened allowing recovered refrigerant from the recovery tank to recycle relieving pressure and temperature. This procedure keeps the recovery tank pressure and temperatures down.

GENERAL OPERATION

In operation of the main compressor unit 12, the first accumulator 48 is operated as a heat exchanger by allowing liquid refrigerant to build up inside effectively cooling gas/liquid flow through line 84 (in the configuration of a coil in the accumulator 48) toward the subcooler unit 14. The pressure regulator 62 prevents liquid refrigerant from reaching the second accumulator 58 to ensure no liquid refrigerant reaches the compressor 66 that could possible damage the compressor 66.

In the quick liquid recovery method shown diagramatically in FIG. 4, the vapor port 34 is connected by service line 32 to the inport 30, since both a combination of gas and liquid is drawn off the top of the recovery tank 22. Recirculating the gas and liquid from the recovery tank 22 at this point in the main compressor unit 12 ensures the liquid refrigerant does not reach the compressor 66. In the standard liquid recovery method shown diagramatically in FIG. 6, the service line 120 is connected at tank inlet 122 to the line 56 of the main compressor unit 12, since mainly gas is drawn off the top of the recovery tank 22. Thus, in the standard liquid recovery method the refrigerant recirculated from the recovery tank can be introduced at a position in the main compressor unit 12 closer to the compressor 66 than in the quick liquid recovery method, since the refrigerant drawn off the top of the recovery tank is mainly gas.

In the subcooler unit 14, the heat exchanger 86 containing antifreeze functions to remove heat energy from the liquid/gas passing along line 89 (in the configuration of a coil inside the heat exchanger 86). Importantly, the heat exchanger also functions as a heat sink due the substantial heat capacity of the antifreeze. This prevents the cooling circuit of the subcooler unit and the line 89 from freezing up during periods of operation.

RECOVERING RECOVERY APPARATUS REFRIGERANT

Figure 7:
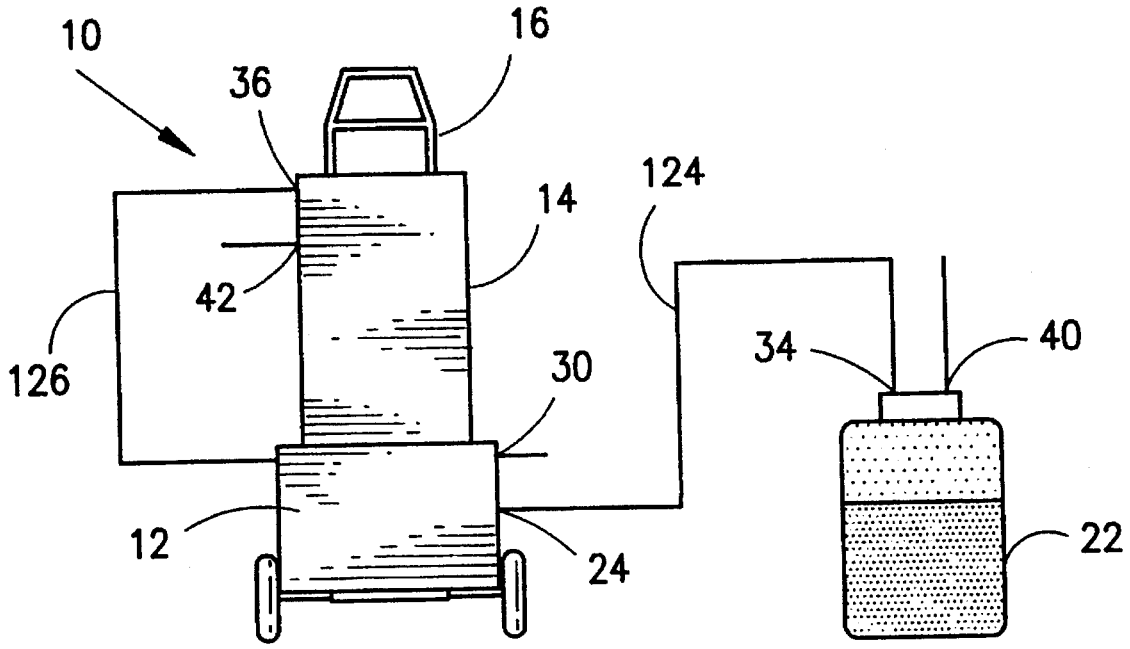
FIG. 7 is a schematic diagram of a configuration for recovering refrigerant from the recovery unit itself.
Figure 8:
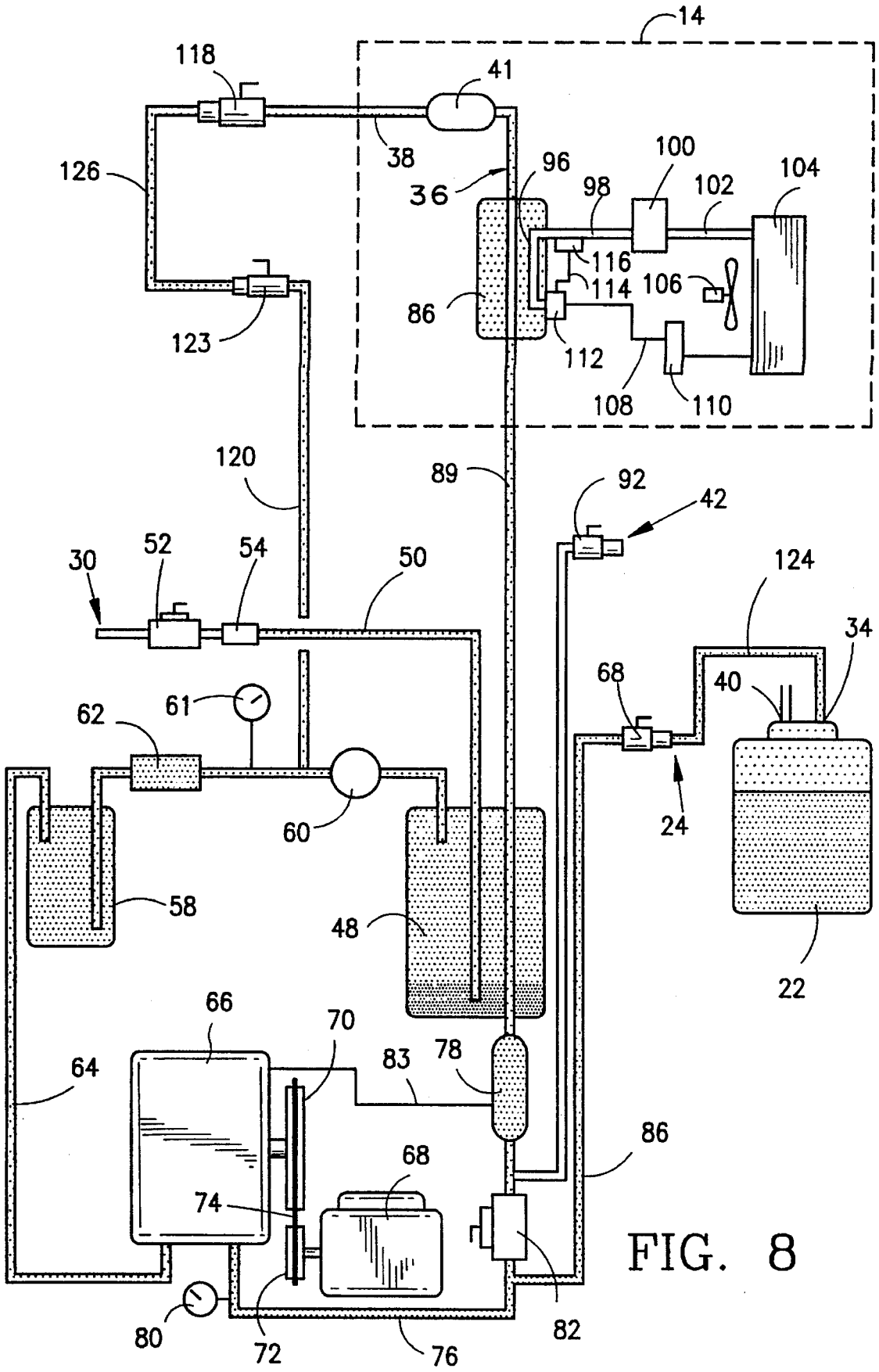
FIG. 8 is a detailed schematic diagram of a configuration for recovering refrigerant from the recovery unit itself.

The configuration for recovering refrigerant from the recovery apparatus, itself after use, is illustrated in FIGS. 7 and 8.

The vapor port 34 of the recovery tank 22 is connected by line 124 to the outport 24 of the main compressor unit 14. A service line 126 is connected between flare ball valves 118 and 123. The liquid port 40 of the recovery tank 22, the inport 30 of the main compressor unit 12, and the inport 42 of the subcooler unit 14 are closed.

This configuration provides one of the best features of the apparatus. If done correctly, the only loss of refrigerant is from the service hoses to the recovery tank, and a one-foot piece of 3/8" soft copper tubing and a one-foot piece of 3/16" soft copper tubing in the recovery apparatus. The amount of refrigerant lost can be further reduced by using service hoses with quick disconnect connectors, which seal off when disconnected.

This procedure allows the recovery unit to recover refrigerant remaining in the unit after the main recovery operation(s). The subcooler valve 82 is closed isolating the recovery compressor 66 from the condensing section 14 of the recovery apparatus. There is not much refrigerant in the recovery unit by system design, so that the procedure will take little time.

SEPARATE SUBCOOLING UNIT

Figure 9:
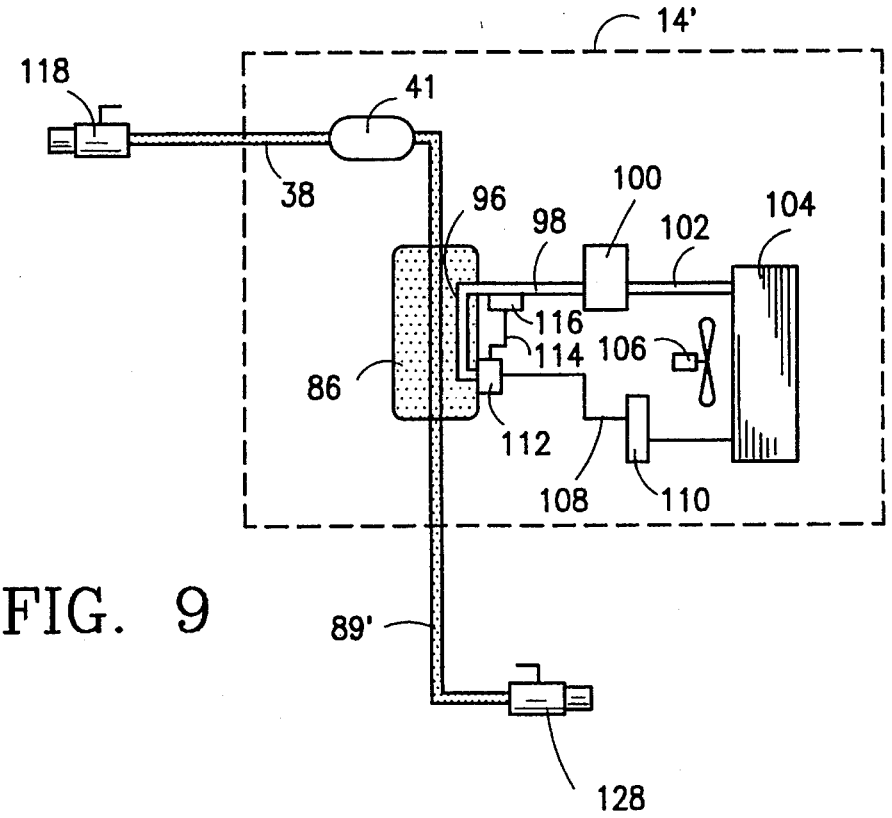
FIG. 9 is a detailed schematic diagram of a configuration for an auxilliary subclooler unit.
Figure 10:
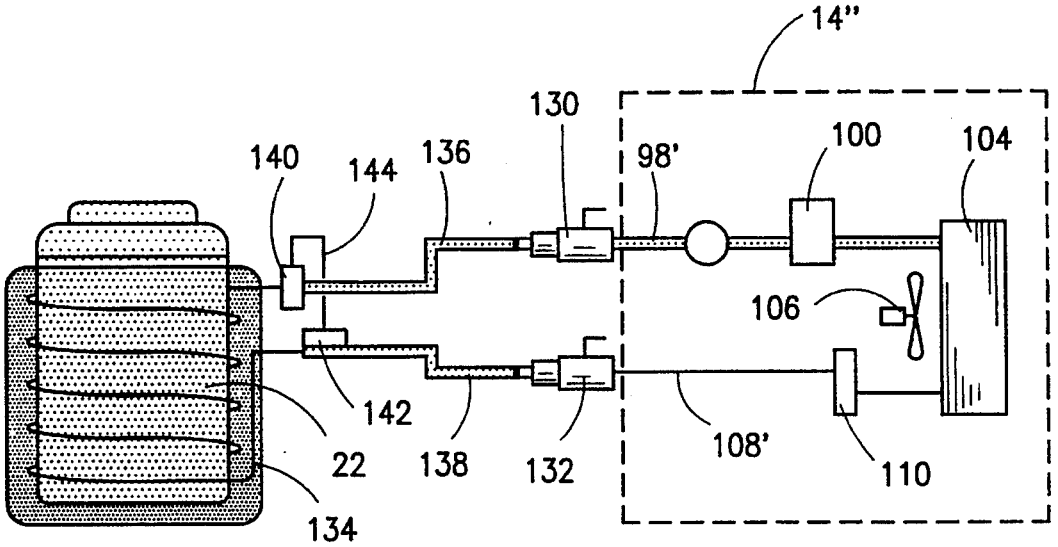
FIG. 10 is a detailed schematic diagram of a configuration for another embodiment of an auxilliary subcooler unit.

The configurations for separate auxiliary subcooling units are illustrated in FIGS. 9 and 10.

In the application shown in FIG. 9, the subcooler unit 14' is a separate auxiliary unit that can be used with a conventional recovery unit to enhance its ability to rapidly collect refrigerant, and increase the extent of filling of the recovery tank.

The subcooler unit 14' contains the same components as the subcooling unit 14 in the embodiments of FIGS. 1–8. However, the line 89' is provided with a Schrader valve or flare ball valve 128 for connecting with a conventional recovery unit.

In the application shown in FIG. 10, the subcooler unit 14" comprises a compressor 100, low temperature condenser unit 104, electric fan 106 in the same configuration shown for the other subcoolers 14 and 14' described in connection with the embodiments of FIGS. 1–9. However, the line 98' is provided with a Schrader valve 130 and the line 108' is provided with a Schrader valve 132.

The subcooling unit 14" is connected to a heat exchanger 134 configured for holding the recovery tank 22. Specifically, a line 136 and a line 138 connect the subcooling unit 14" to the heat exchanger 134. The line 136 is fitted with an expansion valve 140 and the line 138 is fitted with an expansion valve sensing bulb 142. The expansion valve 140 and sensing bulb 142 are connected together by capulary tube 144.

Figure 11:
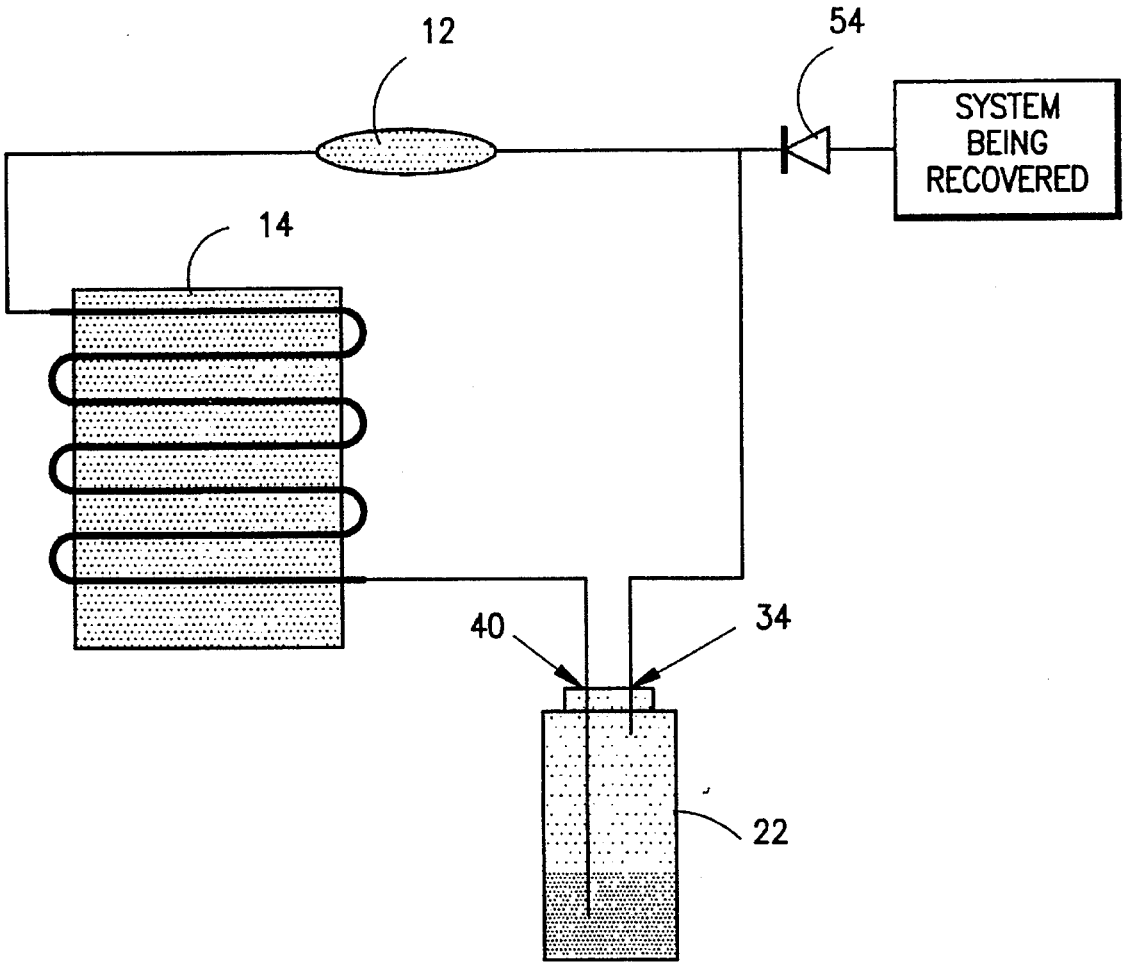
FIG. 11 is a simplified schematic diagram of one embodiment of the system according to the present invention.

In the simplified diagram shown in FIG. 11, the main compressor unit 12 recirculates the gas from the top of the recovery tank 22 back through the main compressor unit 12 and subcooler unit 14 one or more cycles until most or all refrigerant is liquidified and recovered in the tank.

FAN CONDENSER EMBODIMENT

Figure 12:
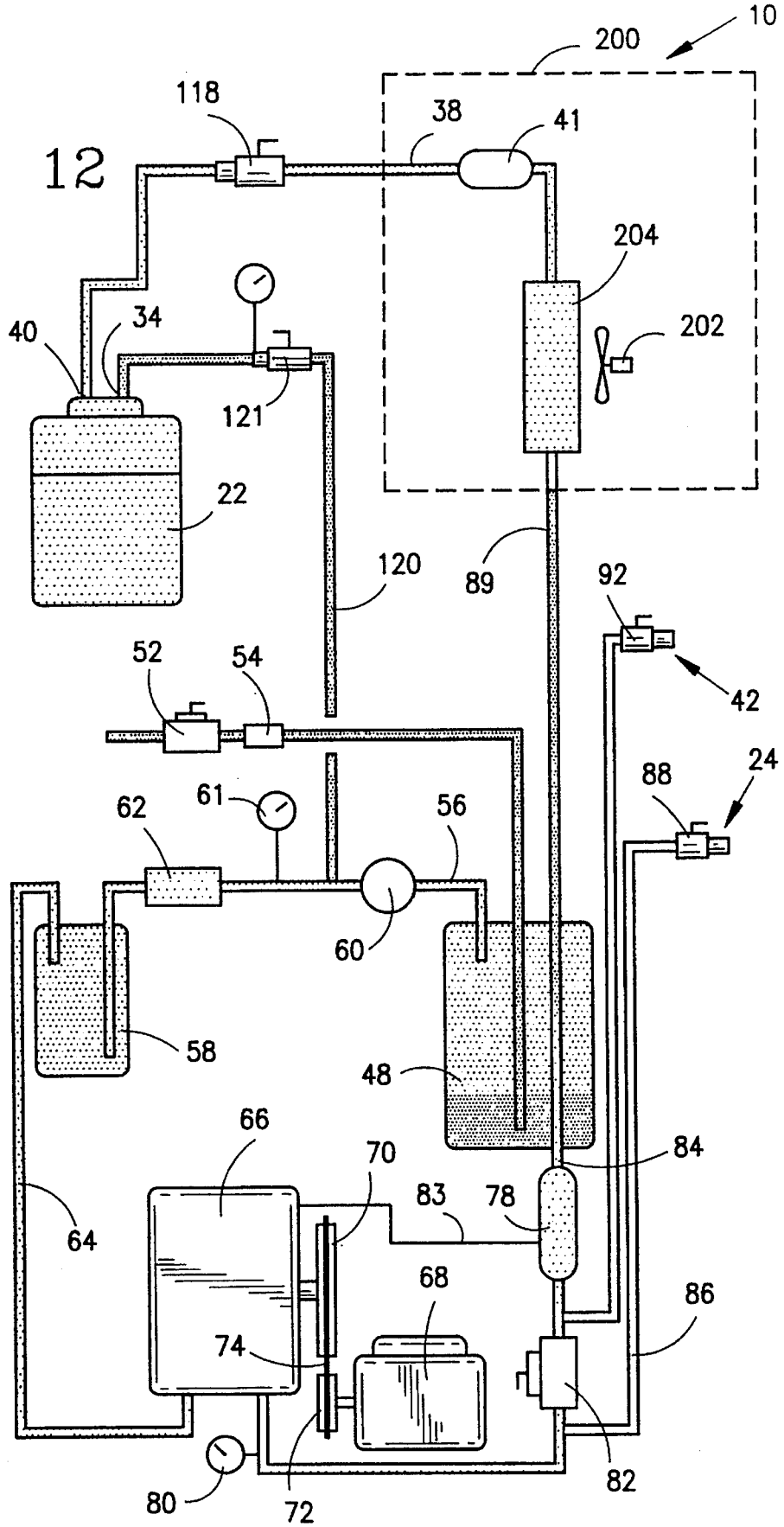
FIG. 12 is a detail schematic view of a further embodiment of the present invention with a fan condensing unit.

A further embodiment of the present invention is shown in FIG. 12. In this embodiment, a fan condensor unit 200 is provided in place of the subcooler unit 14 in the above described embodiments for precooling the refrigerant prior to recovery in the recovery tank 22. The condenser unit 200 comprises a motorized fan 202 and a condensor 204.

| PROTOTYPE SYSTEM PARTS LIST |
|---|
| Subcooler: |
| 1 - ¼ Hp low temperature condensing unit w/receiver |
| 2 - 6" PVC end caps |
| 1 - 6" PVC pipe |
| 1 - 50' roll 3/8" soft copper |
| 1 - 10' roll ¼ soft copper |
| 2 - gallons of −40 degree rated antifreeze |
| 1 - −40 to 100 degree temperature gauge |
| 1 - type FC thermostatic expansion valve |
| 2 - ¼" flare ball valves |
| 2 - sight glasses |
| 2 - ½" male to ⅜" compression brass fittings |
| 2 - ⅜" male to ¼" compression brass fittings |
| Main Compressor Unit: |
| 1 - 1½ Hp, 115 Volt, electric motor |
| 1 - 1½ Hp, belt driven compressor |
| 1 - HX3702 Suction Accumulator w/ heat x coil |
| 1 - S5580 AC&R oil separator |
| 2 - ½" ball valves |
| 1 - sight glass |
| 1 - 10' of 5/16" soft copper tubing |
| 1 - 3' of ½" soft copper tubing |
| 1 - 10' of ⅜" soft copper tubing |
| 1 - 15' of 3/16" soft copper tubing |
| 4 - ½" male to ⅜" male flare fitting |
| 1 - ⅜" flare swivel union |
| 1 - ⅜" flare male tee |
| 2 - ⅜" female flare to ¼" male flare |
| 6 - ⅜" flare nut |
| 2 - ¼" flare ball valves |
| 1 - hand truck w/ inflated tires |
| 1 - low pressure gauge |

-continued

| PROTOTYPE SYSTEM PARTS LIST |
|---|
| 1 - high pressure gauge |
| 1 - refrigerant one-way valve |
| - assorted sheet metal, 2" angle iron, sheet metal screws, pop rivets, and perforated sheet metal |

DESCRIPTION OF PARTS USAGE

1) Inlet Regulating Ball Valve—provides isolation and regulation of the refrigerant from the system being recovered;

2) One Way Valve—prevents recovered refrigerant from returning to system being recovered;

3) HX3702 Suction Accumulator—liquid refrigerant entering accumulator is turned into gas form by an internal hot gas coil leaving compressor. The hot gas leaving the compressor is cooled by liquid refrigerant entering accumulator and surrounding hot gas coil;

4) Sight Glass—by observing refrigerant leaving the HX3720 accumulator, if liquid is observed, the regulating ball valve can be restricted until sight glass again clears;

5) Low Pressure Gauge—in this location with the recovery tank vapor port closed, the existing pressure in the system being recovered can be observed. Opening the vapor port and closing the regulating ball valve allows observation of the recovery tank pressure being reduced;

6) Pressure Regulator—set for 40 psi, the regulator allows from maximum protection of the compressor. At this pressure, the HP3701 accumulator is assured to convert to gas any liquid reaching this point;

7) HP3701 Suction Accumulator—installed for compressor safety to assure only gas at 40 psi enters compressor;

8) Belt Driven 1½ Hp Compressor—designed for refrigerant recovery. The belt driven design prevents acid burnout refrigerant from deteriorating the compressor's performance;

9) High Pressure Gauge—in this location, the load on the compressor can be determined and the starting hot gas pressure is observed;

10) High Pressure Cutout—installed with the high pressure gauge, and will shut down the compressor if 375 psi is reached;

11) Subcooler valve—purpose is to allow isolation of cooling section from main compressor section. The location allows for most complete recovery of refrigerant from recovery unit itself;

12) Oil Separator—purpose is to recover oil migrating from compressor and transfer it back to the compressor's crankcase. The reason it is located after the subcooler valve is due to the volume of hot gas that it contains;

13) antifreeze filled heat exchanger—purpose is to remove the heat from the recovery refrigerant necessary for the most liquid conversion possible. A digital thermometer submerged in the antifreeze shows the heat sink temperature. The low temperature condenser unit removes the heat from the antifreeze filled container by the use of an evaporator coil submerged in the antifreeze; and 14) sight glass—purpose is to observe condition of refrigerant leaving cold trap subcooler.

PERFORMANCE

A prototype with the above specification has been constructed and experimented with to determine the performance of the unit.

At an indoor and outdoor ambient temperature of seventy (70) degrees, Fahrenheit, both coils at ambient temperature, and an empty 40 lb recovery tank with vacuum drawn, the prototype recovers an average of 6 lb residential system to vapor level in the system by two (2) minutes. The liquid discharge to the recovery tank will continue until the system is drawn into vacuum level within fifteen (15) minutes.

The time will vary depending on flash gas action occurring in the system being recovered. Using two (2) 30 lb recovery tanks, and transferring refrigerant between them, using 10 lbs of refrigerant, transfer is complete in thirty (30) minutes. Complete transfer includes recovered tank to vacuum level and recovery tank near ambient temperature not using the quick liquid recovery method.

Speeding up the process of recovering refrigerant from a customer's system can be accomplished in several ways. With a warm air furnace combined with an air conditioner, running the furnace during the recovery operations heats the indoor coil and keeps the pressure up in the system being recovered. With a heat pump system, heat cannot be added as easily, however, running the indoor fan will aid in keeping the indoor coil up to ambient temperatures. With an isolated air conditioner, the same procedure as the heat pump system is used.

If the recovery unit has the capability of installing two (2) separated service hosed from the liquid and suction line connections of the system to the inlet of the recovery unit, the volume of recovery is again increased.

I claim:

1. A refrigerant recovery system for recovering used refrigerant from an existing refrigerant system, comprising:

a refrigerant system connector for connecting the refrigerant recovery system into the existing refrigerant system;

a check valve fluidly connected to said refrigerant system connector;

a main compressor unit for compressing refrigerant withdrawn from the existing refrigerant system, said main compressor unit is fluidly connected to said check valve;

a cooler unit fluidly connected to said main compressor unit for receiving and cooling compressed refrigerant from said main compressor unit;

a recovery tank having a liquid port fluidly connected to said cooler unit for receiving cooled compressed liquid/gas from said cooler unit, said recovery tank having a vapor port fluidly connected to said main compressor unit;

a fluid connection extending from said vapor port of said recovery tank to a position in said fluid connection between said check valve and said main compressor, said fluid connection is a continuously open connection for continuously recirculating refrigerant vapor from said recovery tank again through said main compressor unit and said cooler unit throughout operation of the system while simultaneously withdrawing refrigerant from the existing refrigerant system to increase the rate and degree of recovery of refrigerant into said recovery tank.

2. A refrigerant recovery system according to claim 1, wherein said cooler unit is a subcooler unit comprising a heat exchanger connected to a cooling circuit for cooling refrigerant being recovered from said main compressor.

3. A refrigerant recovery system according to claim 2, wherein said heat exchanger comprises a container at least partially filled with antifreeze.

4. A refrigerant recovery system according to claim 3, wherein said antifreeze is one selected from the group consisting of a single liquid antifreeze, a mixture of liquid antifreezes, a mixture of antifreezes, and a gel.

5. A refrigerant recovery system according to claim 2, wherein said cooling circuit comprises a compressor and low temperature condenser unit having a fan.

6. A refrigerant recovery system according to claim 3, wherein said cooling circuit comprises a compressor and low temperature condenser unit having a fan.

7. A refrigerant recovery system according to claim 2, wherein said subcooler comprises:

a cooling circuit connected to said heat exchanger for cooling said heat exchanger;

a connection for connecting said heat exchanger to the main compressor unit of the refrigerant recovery system; and a connection for connecting said heat exchanger to the recovery tank.

8. A refrigerant recovery system according to claim 1, wherein said cooler unit is a precooler unit defined by a fan condenser unit.

9. A refrigerant recovery system, comprising:

a recovery tank having a liquid port and a vapor port;

a main compressor unit connected to said liquid port of said recovery tank during operation;

a cooler unit for cooling recovered refrigerant from said main compressor, said cooler unit connected between said main compressor and said liquid port of said recovery tank during operation;

a restricted fluid connection between said vapor port of said recovery tank and said main compressor for continuously recirculating recovered vapor refrigerant from said recovery tank back through said main compressor unit and cooler unit throughout the operation of the system;

a recovery system connection for connecting an existing refrigerant system to said main compressor unit; and a check valve positioned between said refrigerant system connection and said main compressor to allow refrigerant to be recovered from said existing refrigerant system while continuously recirculating recovered vapor from said vapor port of said recovery tank back through said main compressor unit and said cooler unit.

10. A system according to claim 9, wherein the refrigerant in said recovery tank is reciculated through said main compressor unit and cooler unit until essentially all refrigerant is in the form of liquid refrigerant in said recovery tank.

11. A system according to claim 9, wherein said cooler unit is a subcooler unit.

12. A refrigerant recovery system according to claim 9, wherein said restricted fluid connection between said recovery tank is provided by throttling said vapor port of said recovery tank.

13. A refrigerant recovery system according to claim 9, wherein said connection between said vapor port of said recovery tank and said main compressor is located between said connection between said one-way valve and said main compressor.

14. A refrigerant recovery system according to claim 12, wherein said connection between said vapor port of said recovery tank and said main compressor is located between said connection between said one-way valve and said main compressor.

* * * * *